US007406909B2

(12) United States Patent
Shah et al.

(10) Patent No.: US 7,406,909 B2
(45) Date of Patent: Aug. 5, 2008

(54) APPARATUS COMPRISING ARMOR

(75) Inventors: Tushar K. Shah, Columbia, MD (US); Mahendra Maheshwari, Bel Air, MD (US); Greg W. Klein, Bel Air, MD (US)

(73) Assignee: Lockheed Martin Corporation, Bethesda, MD (US)

( * ) Notice: Subject to any disclaimer, the term of this patent is extended or adjusted under 35 U.S.C. 154(b) by 635 days.

(21) Appl. No.: 11/186,650

(22) Filed: Jul. 21, 2005

(65) Prior Publication Data

US 2007/0089595 A1 Apr. 26, 2007

(51) Int. Cl.
*F41H 5/04* (2006.01)
*B23K 20/08* (2006.01)

(52) U.S. Cl. ..... 89/36.02; 228/2.5

(58) Field of Classification Search ..... None
See application file for complete search history.

(56) References Cited

U.S. PATENT DOCUMENTS

| | | | | |
|---|---|---|---|---|
| 2,376,331 | A * | 5/1945 | Abrams | 89/36.08 |
| 3,636,895 | A * | 1/1972 | Kelsey et al. | 109/78 |
| 4,545,286 | A * | 10/1985 | Fedij | 89/36.02 |
| 4,585,155 | A | 4/1986 | Berman | |
| 4,878,415 | A | 11/1989 | Foster, Jr. et al. | |
| 4,887,761 | A * | 12/1989 | Hardwick | 228/107 |
| 5,012,721 | A * | 5/1991 | Medin et al. | 89/36.17 |
| 5,390,580 | A | 2/1995 | Gibbons, Jr. et al. | |
| 5,413,027 | A * | 5/1995 | Mixon | 89/36.17 |
| 5,661,254 | A * | 8/1997 | Steuer et al. | 89/1.815 |
| 6,336,611 | B1 * | 1/2002 | Collinucci | 244/129.4 |
| 7,299,736 | B2 * | 11/2007 | Mayseless | 89/36.17 |
| 2006/0086243 | A1 * | 4/2006 | Seo et al. | 89/36.17 |
| 2006/0191403 | A1 * | 8/2006 | Hawkins et al. | 89/36.05 |
| 2007/0068755 | A1 * | 3/2007 | Hawkins et al. | 188/371 |
| 2008/0105114 | A1 * | 5/2008 | Gabrys | 89/36.02 |

FOREIGN PATENT DOCUMENTS

| | | | |
|---|---|---|---|
| DE | 43 44 711 | A1 | 7/1995 |
| FR | 502 431 | A | 5/1920 |
| WO | 91/07337 | A | 5/1991 |

* cited by examiner

*Primary Examiner*—Kiley Stoner
(74) *Attorney, Agent, or Firm*—DeMont & Breyer LLC

(57) ABSTRACT

An armor that is used, for example, in multi-cell missile launchers is disclosed. In some embodiments, the armor includes three layers. The inner-most layer undergoes explosive welding when exposed to a pressure wave from an explosion. An intermediate layer in-elastically deforms when exposed to the explosion. The third and outer-most layer includes a plurality of elongated, pressurized tubes that contain fire retardant, among other chemicals. Silicone gel is interposed between the tubes.

18 Claims, 6 Drawing Sheets

APPARATUS COMPRISING ARMOR

FIELD OF THE INVENTION

The present invention relates generally to armor, such as can be used to improve the survivability of a missile launcher.

BACKGROUND OF THE INVENTION

FIG. 1 depicts conventional multi-cell missile launcher 100. The launcher comprises launcher body 102, which contains a plurality of compartments or cells 104. Each cell is capable of launching missile 106. Multi-cell missile launcher 100 is often used on ships and military vehicles.

Since it is an offensive weapon, launcher 100 is likely to be targeted by enemy combatants. Due to its heat signature, launcher 100 is often one of the more detectable features on the deck of a ship. If one of the missiles in launcher 100 is hit by an incoming ordinance, it is likely that the missile will explode. Explosion of one of the missiles within launcher 100, whether due to a strategic hit or simply a malfunction, can trigger sympathetic detonation of other missiles within launcher 100. While a ship, especially a larger one, will be able to withstand a strike from a single missile, sympathetic detonation of multiple missiles within launcher 100 can cause a catastrophic event; namely, destruction of the ship.

To decrease the likelihood of sympathetic detonations, cells 104 in launcher 100 will usually be armored with conventional armor (not depicted in FIG. 1). The protection afforded by conventional armor is proportional to its thickness. Unfortunately, the weight of the armor is also proportional to its thickness, which constrains the amount of armor that can be used. The bottom line is that the armor that is present in cells 104 offers little protection against sympathetic detonation.

SUMMARY OF THE INVENTION

The present invention provides improved armor that limits the effect of strategic hits and decreases the likelihood of sympathetic detonation, such as in multi-cell missile launchers.

In accordance with the illustrative embodiment of the invention, missile cells are lined with an armor that limits the destructive effects of a missile explosion without some of the cost and disadvantages of the prior art and with enhanced performance.

The armor is multi-functional and, in some embodiments, multi-layered. With regard to functionality, the armor provides one or more of the following functions, in addition to any others:

absorbs a significant portion of the blast energy;

restricts the scatter of blast fragments; and retards the spread of fire.

The functionally provided by the layers of the armor is not, per se, segregated by layer. That is, some layers provide multiple functions and more than one layer can provide the same function.

In the illustrative embodiment, the armor comprises three layers. The first or inner-most layer (i.e., the layer nearest to a missile) is appropriately configured to explosively weld when exposed to blast energy. The second layer is an energy-absorbing layer that, in the illustrative embodiment, comprises a sandwich structure wherein two plates are separated via crushable cross members. The third layer comprises a plurality of pressurized tubes. In some embodiments, the tubes are filled with a flame-retardant liquid.

Regarding the first layer, the process of explosive welding requires a substantial amount of energy, which in accordance with the illustrative embodiment, is sourced from blast energy. Driving the explosive welding of the first layer with energy from the blast withdraws or "consumes" a substantial portion of the blast energy. The energy that drives the welding process is, therefore, not available to cause damage beyond the cell of origination.

In the illustrative embodiment, the first layer comprises a metallic plate or spline and a plurality of metallic fins that depend therefrom. As is required for explosive welding, the fins are disposed at an (acute) angle relative to plate. When exposed to the pressure wave from a blast, the fins are driven into the plate with such force that the metallic fins weld to the metallic plate.

Changes to both the macro- and microstructure of the first layer occur as a result of explosive welding. One change at the micro level is that the welded material (at least near the welding interface) is "hardened" relative to its pre-welded state. In this hardened state, the materials are better able to resist penetration by blast fragments. Since the propagation of blast fragments lags the pressure wave created by the explosion, the fragments encounter the "hardened" welded structure rather than the pre-welded structure. As a result, a reduced number of blast fragments propagate beyond the first layer, relative to what would otherwise be the case.

It is notable that in the prior art, an enhanced ability to contain blast fragments would come at the expense of additional weight or require the use of exotic materials. And, of course, the weight and price penalties of additional and/or exotic materials must be paid whether or not this extra protection is used; that is, whether or not there is a strategic hit on a missile within a multi-cell launcher. But this is not the case with embodiments of the present invention, wherein the enhanced ability comes as a serendipitous result of the process of explosive welding. In other words, the enhanced ability is not present until it is needed, and it's provided at no additional "cost."

The second layer or middle layer in-elastically deforms when exposed to blast energy, thereby absorbing a significant amount of blast energy. Yet, due to its sandwich configuration, the second layer is relatively light in weight.

The pressurized tubes or chambers that compose the third layer function as a shock dampener, fire retardant, and high-velocity particle trap. To provide this functionality, the tubes contain, in the illustrative embodiment, one or more of materials: liquid, sand, chlorofluorocarbons, nitrogen, argon, and silicone gel. Furthermore, silicone gel is interposed between the tubes or chambers. To the extent that one or more of the tubes/chambers, and cell that contains them, ruptures due to the blast, pressurized liquid jets forth, spraying the surrounding live munitions. Wetting the munitions in this fashion provides cooling to delay the onset of explosion and stems the spread of the fire.

The illustrative embodiment comprises an armor that includes:

- a first layer, wherein said first layer comprises a first structural arrangement that undergoes explosive welding when exposed to an explosion;
- a second layer, wherein said second layer comprises a second structural arrangement that inelastically deforms when exposed to the explosion; and
- a third layer, wherein said third layer comprises a physical adaptation for delaying or preventing sympathetic explosions and stemming the spread of fire.

DETAILED DESCRIPTION

Figure 1:
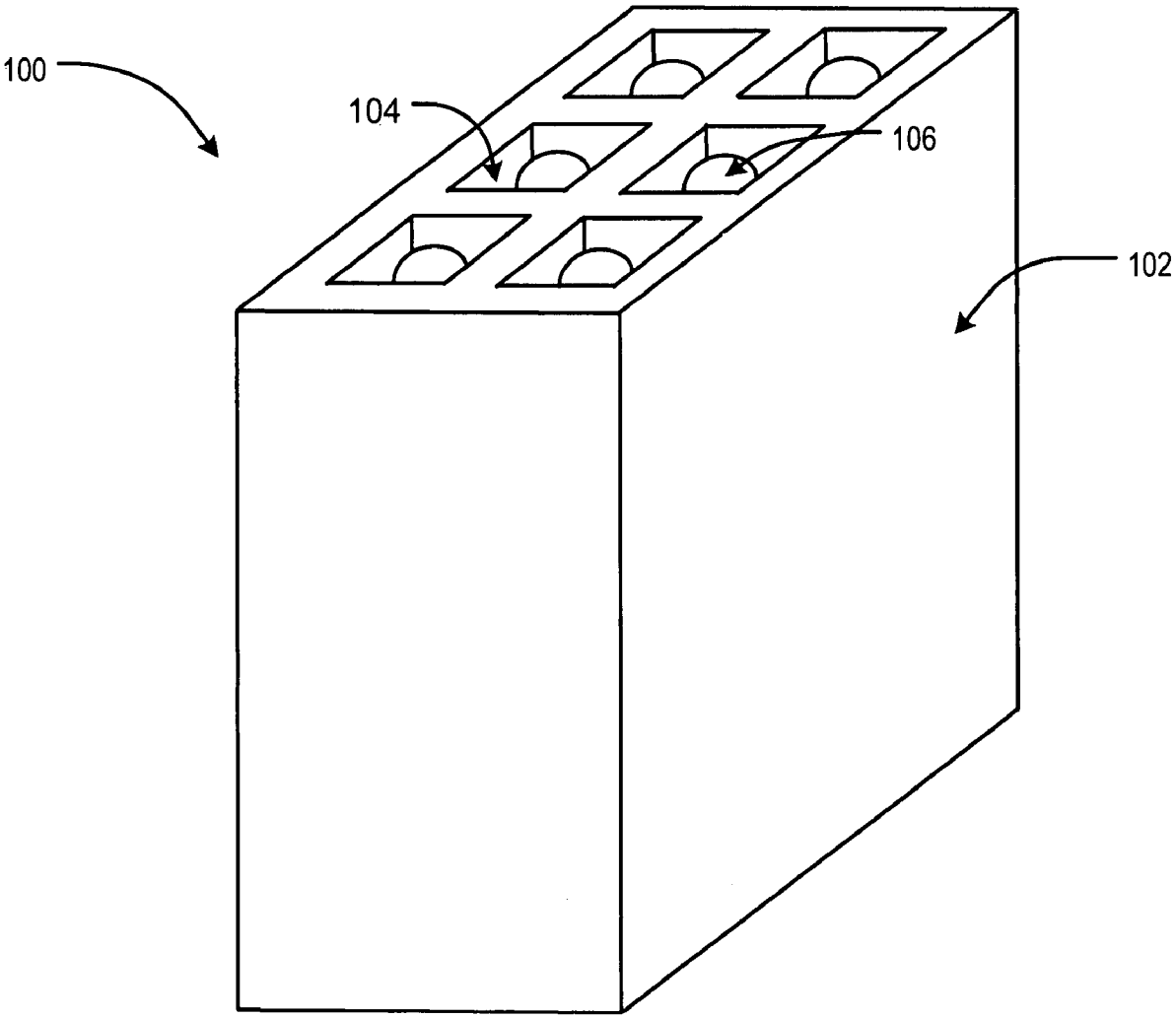
Figure 1 Prior Art
FIG. 1 depicts a conventional multi-cell missile launcher.
Figure 2:
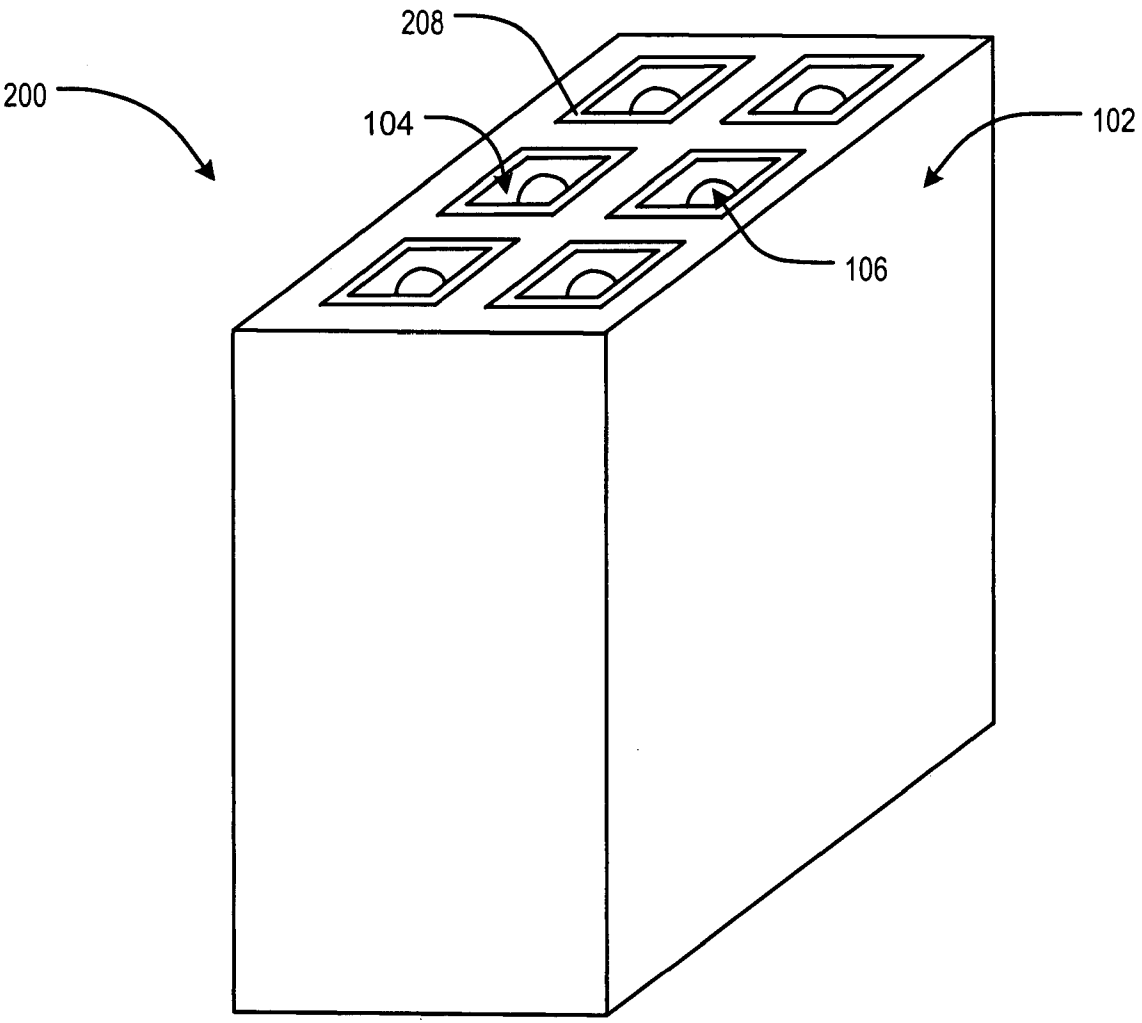
FIG. 2 depicts an armored, multi-cell missile launcher in accordance with the illustrative embodiment of the present invention.

FIG. 2 depicts multi-cell launcher 200 in accordance with the illustrative embodiment of the present invention. Launcher 200 includes launcher body 102, cells 104, and armor 208, arranged as shown. The launcher depicted in FIG. 2 includes six cells 104, each of which contain missile 106. It is understood, however, that some other embodiments of the launcher contain a greater (or lesser) number of cells.

In the embodiment that is depicted in FIG. 2, armor 208 lines the interior of cells 104. In some other embodiments, armor 208 is situated at the exterior of each cell 104. That is, armor 208 is incorporated into launcher body 102.

Figure 3:
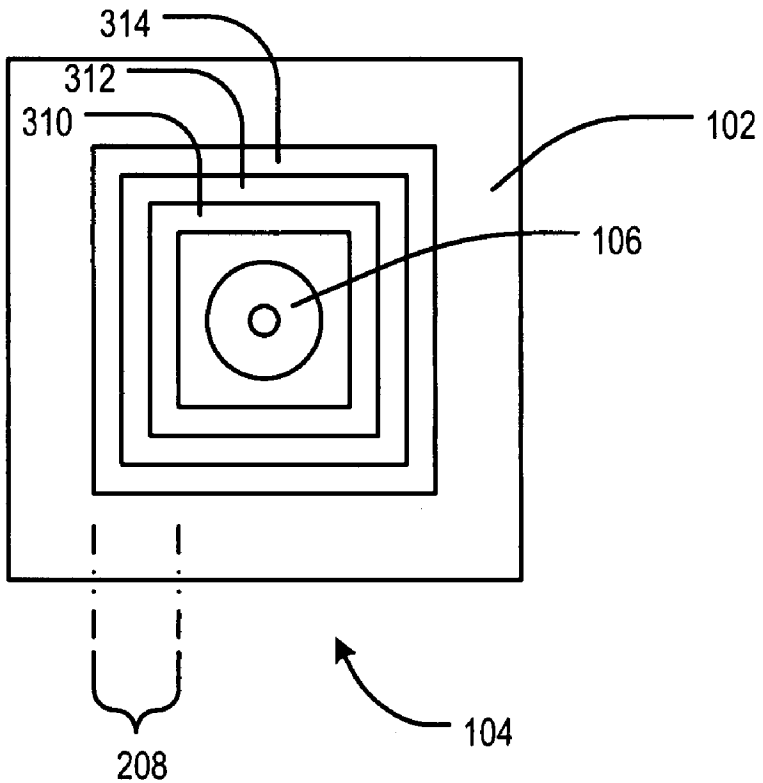
FIG. 3 depicts a top view of a cell of the multi-cell missile launcher of FIG. 2, wherein, in accordance with the illustrative embodiment, the armor comprises three layers.

FIG. 3 depicts a top view of one of the cells 104 of launcher 200. In this embodiment, armor 208 has three layers: first layer 310, second layer 312, and third layer 314. In the illustrative embodiment, first layer 310 is the inner-most layer (i.e., proximal to missile 106), second layer 312 is the middle layer, and third layer 314 is the outer-most layer (i.e., furthest from missile 106) within a given cell.

If missile 106 within a particular cell 104 explodes due to a strategic hit or malfunction, the blast is experienced first by first layer 310, then by second layer 312, and finally by third layer 314 of armor 218 within that cell. While the layers can be arranged differently, the arrangement depicted in FIG. 3 is particularly effective in containing the effects of the blast. The reasons for this will become apparent later in this Specification in conjunction with the description that accompanies FIGS. 4-6.

First layer 310 is primarily intended as an energy-absorbing and fragment-stopping layer. In accordance with the illustrative embodiment, the functionality of first layer 310 is provided by structuring and configuring the layer so that it explosively welds when exposed to blast energy. The process of explosive welding requires a substantial amount of energy, which, in this case, is sourced from blast energy. Driving the explosive welding of inner layer 310 with energy from the blast withdraws or "consumes" a substantial portion of the blast energy. This "withdrawn" energy is not, therefore, available to cause damage beyond the cell of origination.

Second layer 312 is primarily intended as an energy-absorbing layer. This functionality is achieved, in the illustrative embodiment, by structuring and configuring the layer so that it in-elastically deforms when exposed to blast energy. Like the explosive welding of first layer 310, deformation of middle layer 312 is driven by energy from the explosion. While deformation of middle layer 312 will typically not require as much energy as the welding process occurring in first layer 310, it nevertheless withdraws energy that would otherwise cause some degree of damage beyond the cell in which the explosion occurs.

Third layer 314 is intended primarily as a fire-retarding layer and fragment-stopping layer. These functionalities are implemented in the illustrative embodiment by providing a pressurized, flame-retardant liquid (for controlling fire) and silicon gel (for stopping blast fragments).

It will be appreciated that a variety of configurations can be used to achieve the functionality described above for layers 310, 312, and 314. Structural details of an illustrative configuration for each these layers are depicted in FIG. 4 (via an exploded view).

Figure 4:
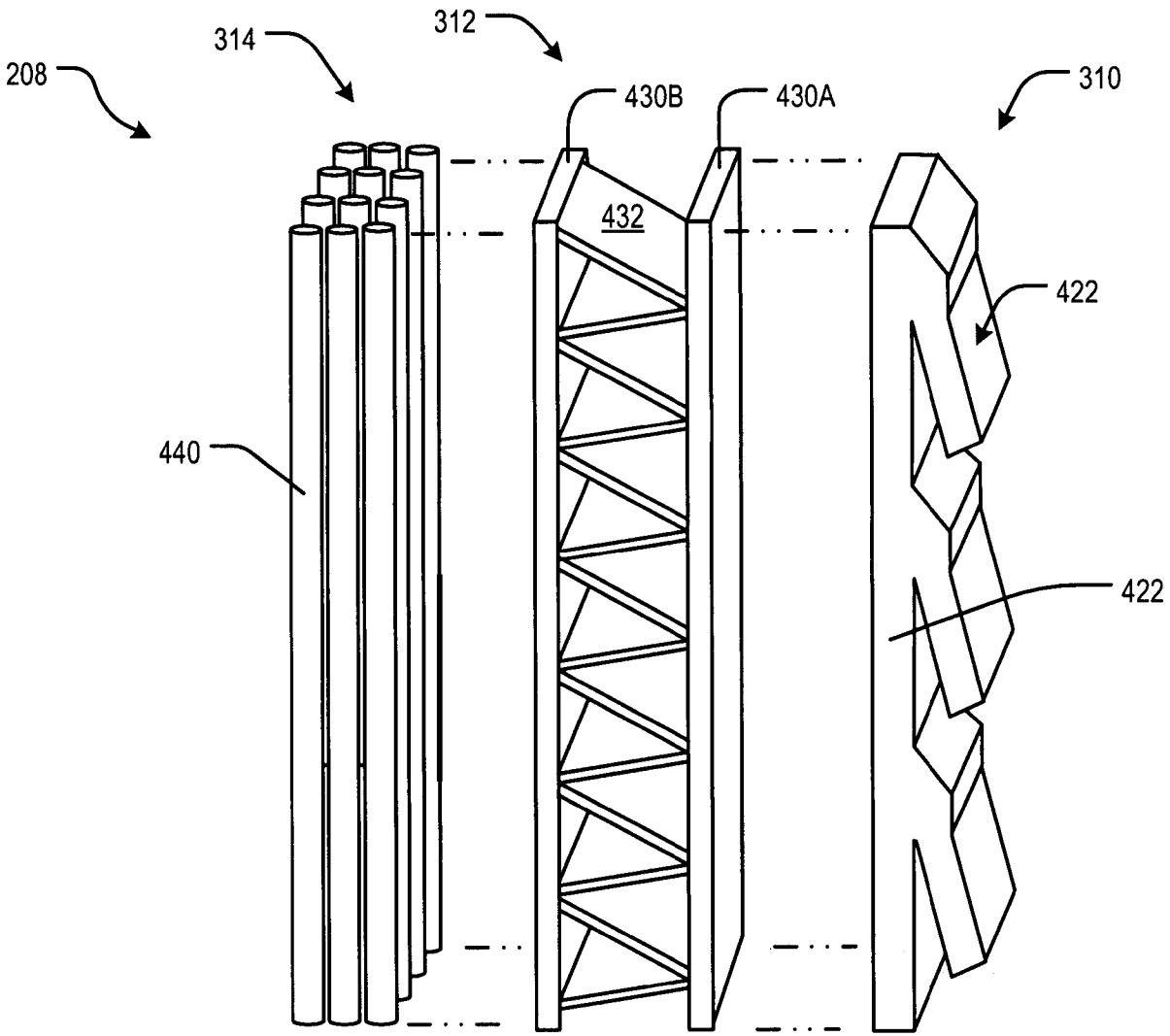
FIG. 4 depicts an exploded view of the armor of FIG. 3, showing exemplary structures for the three layers that compose the armor.

As depicted in FIG. 4, first layer 310 comprises "backbone" or "spline" 420, and a plurality of "fins" 422 that depend therefrom. In the illustrative embodiment, spline 420 and fins 422 are metallic (e.g., steel, etc.) plates, wherein the fins are smaller than the spline. Fins 422 are disposed at an acute angle a relative spline 420. Although three fins 422 are depicted as depending from spline 420 in FIG. 4, in other embodiments, a greater number of splines are present.

Figure 5B:
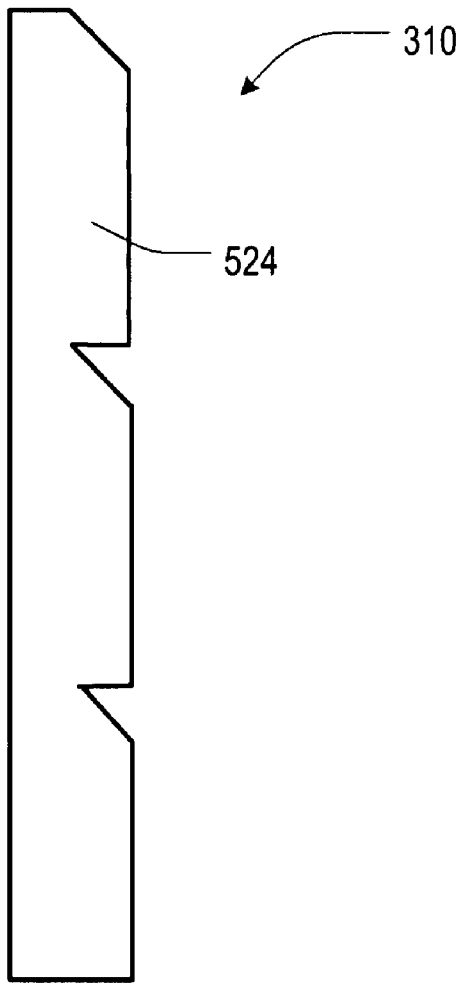
FIG. 5B depicts a side view of the first layer of the armor of FIG. 3 after it is exposed to a pressure wave from an explosion.
Figure 5A:
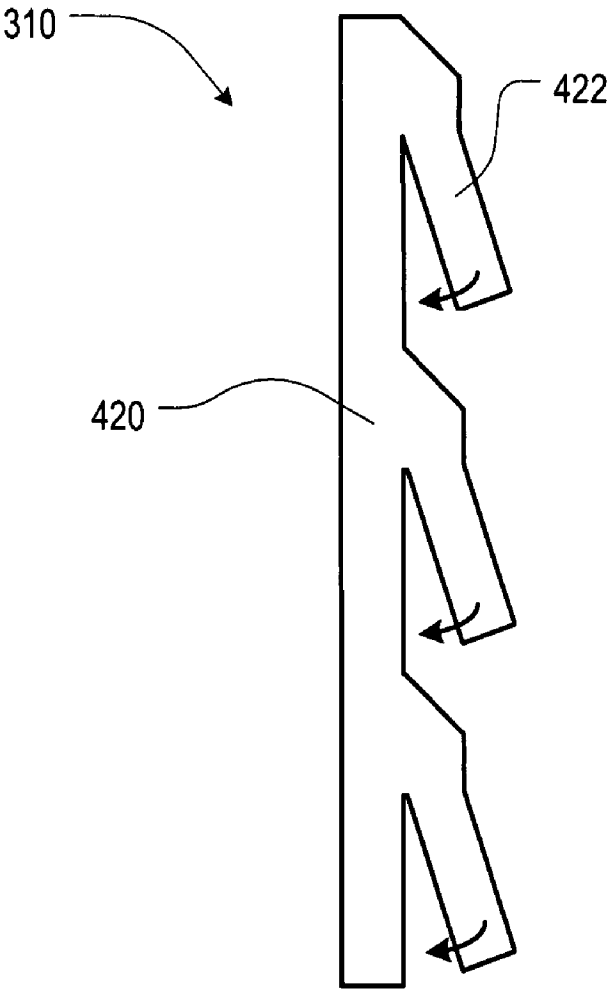
FIG. 5A depicts a side view of the first layer of the armor of FIG. 3 before being exposed to a pressure wave from an explosion.
Figure 6:
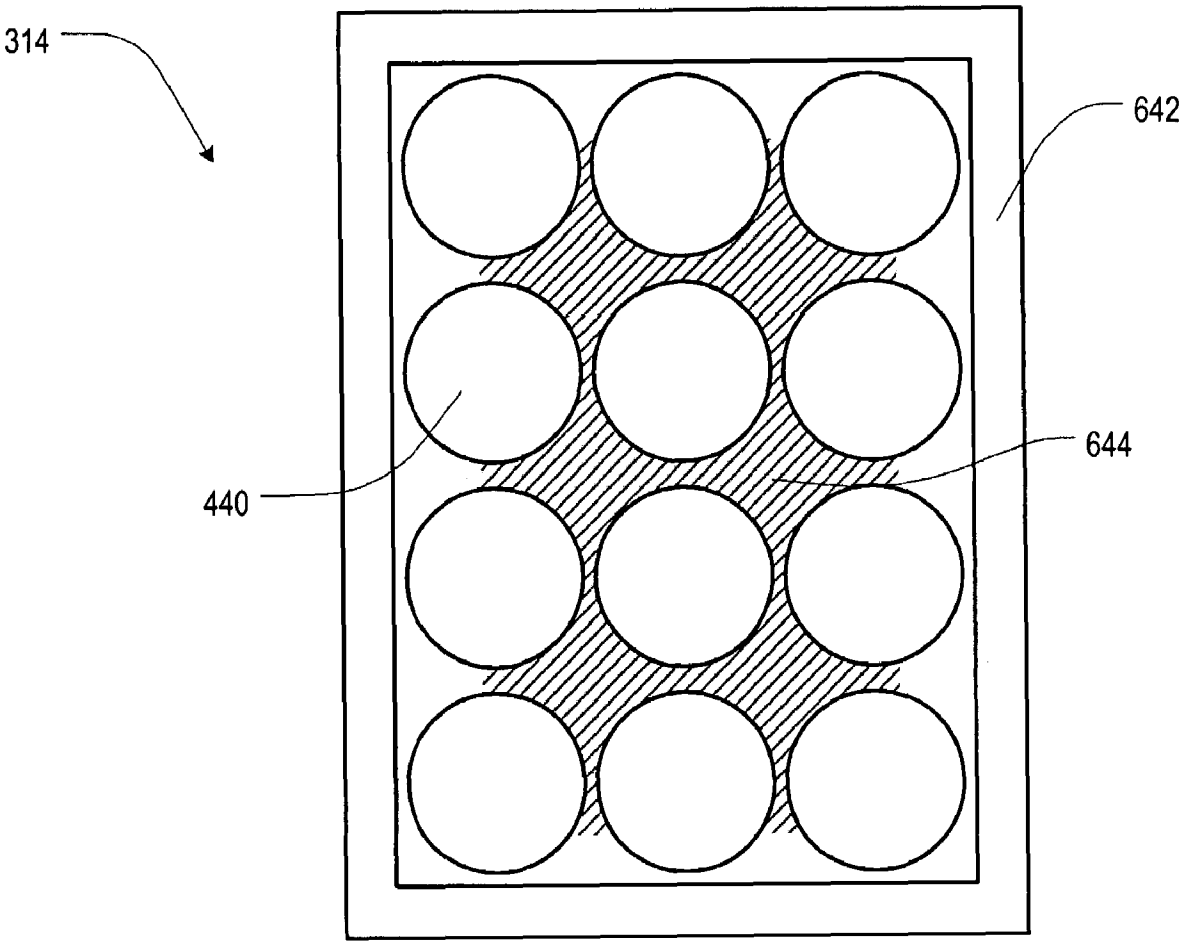
FIG. 6 depicts a top view of the third layer of the armor of FIG. 3.

As previously indicated, when exposed to blast energy resulting from a strategic hit or other undesired explosion, the fins of layer 310 explosively weld to spline 420. FIG. 5A depicts a side view of layer 310 before explosive welding, wherein the arrows indicate the direction of movement of fins 422 when exposed to a pressure wave from a blast. FIG. 5B depicts a side view of layer 310 after explosive welding, wherein fins 422 have welded to spline 420 forming welded members 524. While FIG. 5B depicts all fins 422 that are present on spline 420 as having welded to the spline as a consequence of an explosion, this is not necessarily the case. In fact, as a function of the precise location of the blast and the amount of energy release, fewer than all of the fins on spline 420 might weld to form members 524.

The process of explosive welding is well known, although it has never been used as a feature of armor. Briefly, explosive welding is a solid-state joining process. When an explosive is detonated near the surface of a metal, a high-pressure pulse is generated. The pulse propels that metal at a very high rate of speed. If this piece of metal collides at an angle with another piece of metal, welding can occur. During the process, the first few atomic layers of each metal become plasma as a consequence of the high-velocity impact. Due to the angle of collision, the plasma jets in front of the collision point. This jet scrubs the surface of both metals clean, leaving virgin metal behind. This enables the pure metallic surfaces to join under very high pressures. The metals do not commingle; rather, they atomically bond.

Due to the fact that the metals atomically bond, a wide variety of metals can be bonded to one another via explosive welding. Exceptions include brittle metals with less than about five percent tensile elongation or metals with a Charpy V-notch value of less than about 10 ft-lbs. Metals with these characteristics are not well suited for use in an explosive welding process and, therefore, should not be used for layer 310.

In fact, the arrangement of layer 310 is fairly typical for explosive welding, except for the presence of multiple fins 422. That is, usually only one piece of metal, rather than a plurality of pieces, are welded per explosion. This distinction—welding one piece versus multiple pieces—goes to the heart of the present invention.

In particular, in all known uses for explosive welding, a charge is detonated for the express purpose of welding two materials together. In the context of the present invention, the detonation is unplanned and the energy release is undesired. The explosively-weldable configuration is used to as a sink; that is, to absorb as much energy as possible to limit the extent of the damage caused by the explosion. For that reason, a configuration that provides an opportunity to form as many welds as possible is desired.

The dimensions of spline 420 and fins 422 of layer 310 are dependent upon the nature of the application. In the illustrative embodiment in which armor 208 is used in conjunction with a multi-cell missile launcher, spline 420 is typically in the range of about 1.5 to about 5 feet in length and about 1.5 to about 5 feet in width and fins 422 are typically in the range of about 4 to about 12 inches in length and about 6 to about 36 inches in width, as is consistent with the size of such missile launchers. The thickness of spline 420 and fins 422 is primarily a function of the anticipated amount of energy released during an explosion. The energy released due to a strategic hit will vary based on the specifications of the incoming hostile missile as well as the resident missile 106. Typically, the thickness of spline 420 and the fins 422 will be in the range of about 0.25 to about 3 inches.

A consequence of the explosive welding process that turns out to be particularly advantageous for the present application is that the hardness of the welded structure (at least at the welding interface) increases due to the welding process for some materials. This is believed to be due to the high plastic deformation that occurs at the weld interface during the explosion. For example, when explosively bonding low carbon steel to high Mn steel (16% Mn), the hardness (Hv) of the low carbon steel doubles and the hardness of the high Mn steel triples near the weld interface. The larger increase in the hardness of the high Mn steel is attributable to the higher work hardenability of high Mn steel relative to low carbon steel.

This hardening phenomenon is beneficial, in the context of the present invention, for the following reason. The fragments that are generated by an explosion generally lag the pressure wave. Since the pressure wave triggers the explosive welding process, the lagging fragments encounter a relatively more impervious layer 524 than would be the case if layer 310 were not explosively welded. Consequently, relatively fewer blast fragments will ultimately escape armor 208 to damage missiles 106 in nearby launch cells 104.

While first layer 310 is very effective at "consuming" blast energy, a substantial amount of energy will, of course, propagate beyond this layer. To this end, second layer 312 is configured to "consume" a portion of the blast energy propagating beyond layer 310 by in-elastically deforming when exposed to this energy.

In accordance with the illustrative embodiment, second layer 312 is configured as a "sandwich" structure wherein two plates 430A and 430B are spaced apart by cross members 432. The sandwich structure is made of steel, titanium, aluminum, or any metal that is typically used in the construction of ships. In the illustrative embodiment, plates 430A and 430B are substantially parallel to one another, although this is not required for the effective operation of layer 312.

In the illustrative embodiments, cross members 432 are arranged in a "saw-tooth" pattern, with one end attached to plate 430A and the other end attached to plate 430B. Cross members 432 should be firmly attached to plates 430A and 432B, such as via welds, but other attachment techniques can suitably be used (e.g., heavy duty brackets, etc.).

When exposed to the propagating pressure wave from a blast, cross members 432 collapse, such that plate 430A is driven towards 430B. While the collapse of cross members 432 will typically not require as much energy as the explosive welding of first layer 310, it nevertheless provides a sink for energy from the propagating blast wave. And the energy used in the collapse is not available to cause damage to surrounding structures and contribute to sympathetic detonations of nearby ordinance.

The amount of energy that is required to collapse the sandwich structure of second layer 312 is primarily a function of the thickness and arrangement (e.g., angle, etc.) of cross members 432. Based on the expected amount of energy propagating past first layer 310, those skilled in the art will be able to design and build layer 312 to satisfy an energy sink requirement, subject to applicable space and weight limitations of the device to which armor 208 is applied (e.g., missile launcher 200, etc.).

As will be appreciated by those skilled in the art, the particular pattern of cross members shown in FIG. 4 and the materials composition of second layer 312 are merely exemplary. In some other embodiments, different patterns and different materials of construction are suitably employed. Examples of some of sandwich configurations that can be used in conjunction with the present invention (modified as to cross-member thickness, etc., as appropriate) include those disclosed in U.S. Pat. Nos. 4,217,397, 4,254,188, 4,643,933, all of which are incorporated herein by reference.

In accordance with the illustrative embodiment, third layer 314 comprises a plurality of sealed, pressurized tubes 440, arranged as shown. In some embodiments, tubes 440 are disposed in cell 642 (see, FIG. 6). Tubes 440 are formed from materials(s) that provide high strength, durability, and corrosion resistance. Examples of materials that are suitable for use as tubes 440 include, without limitation, Kevlar®, Ethylene Propylene Diene Monomer (EPDM), or a combination thereof. Cell 642 is formed from material(s) that provide high strength against external forces and resistance to penetration by blast fragments. Examples of materials that are suitable for use as cell 642 include, without limitation, ceramic foam, Kevlar®, or ceramic/Kevlar®.

In some embodiments, a material 644 that provides one or more of the following functions is interposed between tubes 440:

- impedes shockwave propagation;
- provides thermal management;
- provides vibration dampening;
- is hydrophobic to protect internal electronics from condensation; and
- traps fragments.

In accordance with the illustrative embodiment, silicone gel matrix, such as RTV Silicon Rubber Encapsulant from Dow Corning, is used to provide all of the aforementioned functionalities.

In some embodiments, cell 642 is sealed by a cover (not depicted), which provides environmental protection to tubes 440 and inter-tube material 644.

In the illustrative embodiment, each tube 440 contains:

- a pressurized liquid to retard fires and cool live ammunition when the tube is punctured;
- sand to distribute blast pressure across a larger surface area;
- chlorofluorocarbons to retard fire and inhibit it from spreading;
- nitrogen and argon to retard fire and inhibit it from spreading; and
- silicone gel to absorb the applied or experienced mechanical load and to trap blast particles.

As will be appreciated by those skilled in the art, in some other embodiments of the present invention, tubes 440 might contain one or more compounds instead of, or in addition to, those of the illustrative embodiment in order to provide better fire retardation, better energy-absorption capabilities, or another desirable property.

In an alternative embodiment, cell 642 is partitioned into a plurality of chambers (not depicted), which take the place of tubes 440.

In some embodiments, layers 310, 312, and 314 are adjacent to one another, but otherwise unattached. In some other embodiments, one or more of the layers are coupled to another of the layers. For example, in some embodiments, spline 420 of layer 310 is physically attached to plate 430A of layer 312. Attachment is by welding, as appropriate, or using various coupling elements (e.g., brackets, clamps, bolts, etc.). In some embodiments, plate 430B of layer 312 is physically attached to cell 642, via any one of various coupling elements (e.g., brackets, clamps, bolts, etc.). And in some embodiments, all three layers are physically coupled: layer 310 to layer 312 and layer 312 to layer 314.

It will now be appreciated that the illustrative arrangement of the layers of armor 208, wherein layer 310 is the inner-most layer, layer 312 is the middle layer, and layer 314 is the outer-most layer, is particularly efficacious for containing the effects of an explosion. But in some other embodiments, these layers can be arranged differently. For example, in some embodiments, layer 312 is the inner-most layer, layer 310 is the middle layer, and layer 314 is the outer-most layer, etc.

Furthermore, as will be appreciated by those skilled in the art, some other embodiments of armor 208 include only one layer, such as only first layer 310, or only second layer 312, or only third layer 314. Some further embodiments of armor 208 include only two layers, such as layers 310 and 312, or layers 310 and 314, or layers 312 and 314. Similarly, some additional embodiments of the present invention use all three layers in combination with one or more additional layers, arranged in any of the possible combinational orders.

It is to be understood that the above-described embodiments are merely illustrative of the present invention and that many variations of the above-described embodiments can be devised by those skilled in the art without departing from the scope of the invention. For example, in this Specification, numerous specific details are provided in order to provide a thorough description and understanding of the illustrative embodiments of the present invention. Those skilled in the art will recognize, however, that the invention can be practiced without one or more of those details, or with other methods, materials, components, etc.

Furthermore, in some instances, well-known structures, materials, or operations are not shown or described in detail to avoid obscuring aspects of the illustrative embodiments. It is understood that the various embodiments shown in the Figures are illustrative, and are not necessarily drawn to scale. Reference throughout the specification to "one embodiment" or "an embodiment" or "some embodiments" means that a particular feature, structure, material, or characteristic described in connection with the embodiment(s) is included in at least one embodiment of the present invention, but not necessarily all embodiments. Consequently, the appearances of the phrase "in one embodiment," "in an embodiment," or "in some embodiments" in various places throughout the Specification are not necessarily all referring to the same embodiment. Furthermore, the particular features, structures, materials, or characteristics can be combined in any suitable manner in one or more embodiments. It is therefore intended that such variations be included within the scope of the following claims and their equivalents.

What is claimed is:

1. An apparatus comprising armor, wherein said armor comprises:

a first layer, wherein said first layer comprises a first structural arrangement that undergoes explosive welding when exposed to an explosion;

a second layer, wherein said second layer comprises a second structural arrangement that in-elastically deforms when exposed to said explosion; and a third layer, wherein said third layer comprises a physical adaptation for retarding fire due to said explosion.

2. The apparatus of claim 1 wherein said first structural arrangement comprises:

a spline; and a plurality of fins that depend from said spline, wherein said fins are arranged to collapse toward said spline when exposed to a pressure wave from said explosion.

3. The apparatus of claim 1 wherein at least a portion of said first layer is characterized by an increase in hardness due to said explosive welding.

4. The apparatus of claim 3 wherein, relative to its pre explosively-welded condition, said explosively-welded first layer is characterized by an improved ability to stop fragments from said explosion.

5. The apparatus of claim 1 wherein said second structural arrangement comprises a sandwich configuration.

6. The apparatus of claim 5 wherein said sandwich configuration comprises:

(i) two spaced-apart beams; and (ii) a plurality of cross members, wherein said cross members are disposed between said beams and depend therefrom.

7. The apparatus of claim 6 wherein said cross members depend from said beams at a non-orthogonal angle.

8. The apparatus of claim 1 wherein said third layer comprises a plurality of elongated pressurized tubes, wherein said physical adaptation comprises flame-retardant liquid that is disposed in said pressurized tubes.

9. The apparatus of claim 8 wherein said third layer further comprises a thermally-stable gel, wherein said thermally-stable gel is interposed between said tubes.

10. The apparatus of claim 8 wherein said tubes contain at least one material selected from the group consisting of sand, clorofluorocarbons, argon, nitrogen, and silicon gel.

11. The apparatus of claim 1 wherein said apparatus comprises a missile launcher having a launcher body and a plurality of launch cells defined within said launcher body, wherein said armor is disposed within at least some of said launch cells.

12. The apparatus of claim 11 wherein each of said launch cells is defined by a launch-cell wall, and further wherein:

said third layer is proximal to said launch-cell wall;

said first layer is distal to said launch-cell wall; and said second layer is situated between said first layer and said third layer.

13. An apparatus comprising armor, wherein said armor is physically adapted to achieve an enhanced ability to prevent fragments that result from an explosion from penetrating said armor, wherein enhancement occurs as a result of said armor being exposed to a pressure wave from said explosion.

14. The apparatus of claim 13, wherein said armor is characterized by a structural arrangement that undergoes explosive welding when exposed to said pressure wave.

15. The apparatus of claim 13 wherein said apparatus comprises a missile launcher having a plurality of launch cells, wherein said armor is disposed within at least some of said launch cells.

16. An apparatus comprising armor, wherein said armor comprises:

a first layer that is physically adapted to explosively weld when exposed to a pressure wave from an explosion; and a second layer, wherein said second layer comprises:

a plurality of elongated, pressurized tubes, and a thermally-stable gel interposed between said sealed tubes.

17. The apparatus of claim 16 wherein said tubes contain a fire retardant.

18. The apparatus of claim 16 wherein said apparatus comprises a missile launcher having a plurality of launch cells, wherein said armor is disposed within at least some of said launch cells.

* * * * *